US009556864B2

(12) United States Patent
Zollner et al.

(10) Patent No.: US 9,556,864 B2
(45) Date of Patent: Jan. 31, 2017

(54) METHOD AND DEVICE FOR CONTROLLING AN AUXILIARY PUMP FOR A TRANSMISSION

(71) Applicant: ZF Friedrichshafen AG, Friedrichshafen (DE)

(72) Inventors: Tobias Zollner, Lindau (DE); Christoph Ommer, Friedrichshafen (DE); Stefan-Ulrich Prange, Tettnang (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 352 days.

(21) Appl. No.: 13/855,107

(22) Filed: Apr. 2, 2013

(65) Prior Publication Data

US 2013/0272900 A1 Oct. 17, 2013

(30) Foreign Application Priority Data

Apr. 13, 2012 (DE) ..... 10 2012 206 041

(51) Int. Cl.
*F04B 49/00* (2006.01)
*F04B 49/06* (2006.01)
(Continued)

(52) U.S. Cl.
CPC ..... *F04B 49/002* (2013.01); *F04B 17/03* (2013.01); *F04B 49/02* (2013.01); *F04B 49/065* (2013.01);
(Continued)

(58) Field of Classification Search
CPC ..... F04B 49/002; F04B 49/06; F04B 49/065; F04B 17/03; F04B 17/05; F04B 23/04; F04B 2207/043; F04B 2205/503; F04C 14/00; F04C 14/06
(Continued)

(56) References Cited

U.S. PATENT DOCUMENTS 6,719,377 B1 * 4/2004 Zimmermann ..... B60T 8/405 303/115.4
6,769,502 B2 8/2004 Nakamori et al.
(Continued)

FOREIGN PATENT DOCUMENTS

DE 601 27 649 T2 12/2007
DE 10 2008 040 667 A1 1/2010
(Continued)

OTHER PUBLICATIONS

Causes of Oil Foaming—https://web.archive.org/web/20111014120419/http://machinerylubrication.com/Read/1765/foaming-in-oil.*
German Search Report Corresponding to DE 10 2012 206 041.3.

*Primary Examiner* — William H Rodriguez
*Assistant Examiner* — Christopher Brunjes
(74) *Attorney, Agent, or Firm* — Davis & Bujold, PLLC; Michael J. Bujold

(57) ABSTRACT

A method of controlling an auxiliary pump for supplying the hydraulic fluid of a hybrid transmission of a vehicle. The auxiliary pump, after the expiration of a predetermined time interval of deactivation, is activated to prevent accumulation of air in the intake area of the auxiliary pump. In addition, a device for the execution of the method, in which a control device is provided which has its signals connected with the electric auxiliary pump for the purpose of controlling the auxiliary pump in order to prevent accumulation of air in the intake area of the auxiliary pump.

11 Claims, 2 Drawing Sheets

(51) Int. Cl.
*F04B 49/02* (2006.01)
*F04B 17/03* (2006.01)
*F04B 23/04* (2006.01)

(52) U.S. Cl.
CPC ..... *F04B 23/04* (2013.01); *F04B 2205/02* (2013.01); *F04B 2205/09* (2013.01); *F04B 2205/503* (2013.01)

(58) Field of Classification Search
USPC ..... 417/12, 43, 211.5, 213
See application file for complete search history.

(56) References Cited

U.S. PATENT DOCUMENTS

| | | | | |
|---|---|---|---|---|
| 2003/0148850 | A1* | 8/2003 | Tomohiro | B60W 10/30 477/3 |
| 2009/0097984 | A1* | 4/2009 | Kido | F04C 18/126 417/12 |
| 2011/0120568 | A1 | 5/2011 | Borntraeger et al. | |
| 2011/0144846 | A1 | 6/2011 | Zollner et al. | |
| 2013/0270723 | A1* | 10/2013 | Grotheim | B01D 17/0205 261/112.1 |

FOREIGN PATENT DOCUMENTS

| | | | | |
|---|---|---|---|---|
| DE | 10 2009 054 754 | A1 | 6/2011 | |
| WO | WO 2012057629 | A1 * | 5/2012 | B01D 17/0205 |

* cited by examiner

METHOD AND DEVICE FOR CONTROLLING AN AUXILIARY PUMP FOR A TRANSMISSION

This application claims priority from German patent application serial no. 10 2012 206 041.3 filed Apr. 13, 2012.

FIELD OF THE INVENTION

The present invention concerns a method and device for controlling an auxiliary pump for a transmission.

BACKGROUND OF THE INVENTION

It is known in the vehicle technology that hybrid transmissions utilize an electric auxiliary pump to guarantee the hydraulic supply or rather oil supply. The auxiliary pump is actuated if the oil supply cannot be covered by means of a main pump on the transmission side because the transmission input rotational speed is too low. It is hereby assumed that the electric auxiliary pump can immediately start the oil supply when switched on. However, it requires that the intake port and the intake duct are filled with oil so that no air and no oil foam are present. Otherwise, unwanted air intake takes place when the auxiliary pump is again switched on, so that the oil supply of the transmission during that time interval is below the necessary level and therefore shift elements, for instance, cannot be activated.

For instance, known from the publication DE 10 2008 040 667 A1 is a hydraulic system with a transmission device having a main transmission pump and an auxiliary pump, as well as a method to operate the hydraulic system. In the known hydraulic system, to avoid unwanted outflow of the hydraulic fluid or rather oil, in the area of the auxiliary pump into an unpressurized area or into an oil sump, an additional switch-over valve is required which separates the auxiliary pump from the secondary pressure circuit. This not only requires a larger construction effort but it is also costly.

SUMMARY OF THE INVENTION

The present invention has therefore the task to propose a method for controlling of an auxiliary pump and a device to execute the method of the previously described type, through which the intake of air can be avoided without additional constructive effort and therefore with lesser cost.

The task which is based on the invention is solved through a method for controlling or rather turning on or off an auxiliary pump, in which the auxiliary pump, after the elapse of a predetermined time interval of a non-activation, meaning when the auxiliary pump is not needed for the hydraulic supply or oil supply, respectively, is turned on for a predetermined duration to avoid an air build up in the intake area of the auxiliary pump. Thus, air intake during a later desired turning on of the auxiliary pump to supply oil is safely prevented, because the inventive actuation of the auxiliary pump prevents the build-up of air or of oil foam at the intake port in the area of the auxiliary pump. Construction changes at the hydraulic system of the hybrid transmission are not required due to the inventive method. Therefore and independent of the respective construction or drive condition, respectively, negative effects caused by the build-up of air or oil foam at the auxiliary pump can be avoided.

Within this inventive method, the electrically operated auxiliary pump can, for instance, be turned on or turned off in accordance with a determined or randomly selected time pattern or time interval, respectively, when the auxiliary pump has not been actuated over a certain duration of time. The duration of the time interval of the activation or non-activation of the auxiliary pump can be empirically calculated, for instance, through tests. This kind of calculation can be preferably used when there is no knowledge about the creation of foaming. These time intervals can be selected, for instance, as an activation time point or deactivation time point stored for instance in a control device for controlling of the auxiliary pump.

If for instance the information is available regarding which events or operating modes, respectively, a build-up air or oil foam might be created in the intake area of the auxiliary pump, it is possible in accordance with the invention that the triggering or activation or deactivation of the auxiliary pump is executed depending on the creation of events that are favorable for the intake air. These events can be for instance a high-speed drive, a longer uphill drive, or similar.

When such events are present, simultaneously when the auxiliary pump is turned off, another embodiment of the invention can provide that a timer or timer/counter, respectively, is started whereby after a completed count-down of the time in the timer, the auxiliary pump is actuated to possibly apply suction for an air build-up in the intake area. If the auxiliary pump, after the expiration of the predetermined time interval and activation, is turned off and the recognized event is still present at this time, the timer/clock can be again restarted, to again turning on the auxiliary pump device after a time duration has expired. As an alternative, the auxiliary pump can remain turned on until the event is no longer present.

To limit activation of the auxiliary pump due to the recognition of events, a so-called blocking timer or blocking time relay, respectively, can be implemented as part of the invented method. Thus, the activation of the auxiliary pump is prevented for a predetermined time duration, if for instance the event in which the suction of air or foam is expected, was already present and the auxiliary pump has already been turned on. In this case for instance, the blocking time relay can be started after the activation of the auxiliary pump due to a recognized event, so that a turning on of the auxiliary pump is prevented for a determined time duration, and that the timer is again started thereafter if the event is still present.

The activation of the auxiliary pump can also take place, in accordance with the inventive method, depending on a build up of unwanted air or foam, as detected by a sensor, at the intake area of the auxiliary pump. For this purpose for instance, the signals of a special oil foam creation sensor can be used.

The task which is the basis for this invention is also solved by a device which can execute the method, in particular the previously described inventive method. Thus, a device is needed which comprises of a control device for the activation of an auxiliary pump whereby the control device is connected with the electrical auxiliary pump in particular with the control or signals, respectively. Also, the control device can be connected through signals with a detection sensor to detect the threatening suction of air. The described and proposed controlling of the auxiliary pump can therefore be realized in accordance with the device.

BRIEF DESCRIPTION OF THE DRAWINGS

In the following, the present invention is further explained based on the drawings. These show.

DETAILED DESCRIPTION OF THE PREFERRED EMBODIMENTS

Figure 1:
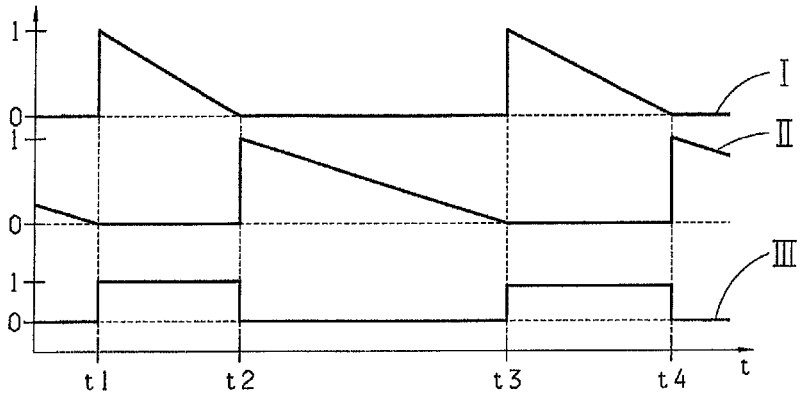
FIG. 1 a graphical representation of a method in accordance with the invention based on a control timing pattern chart of an auxiliary pump with fixed time intervals for activating or deactivating the auxiliary pump.
Figure 2:
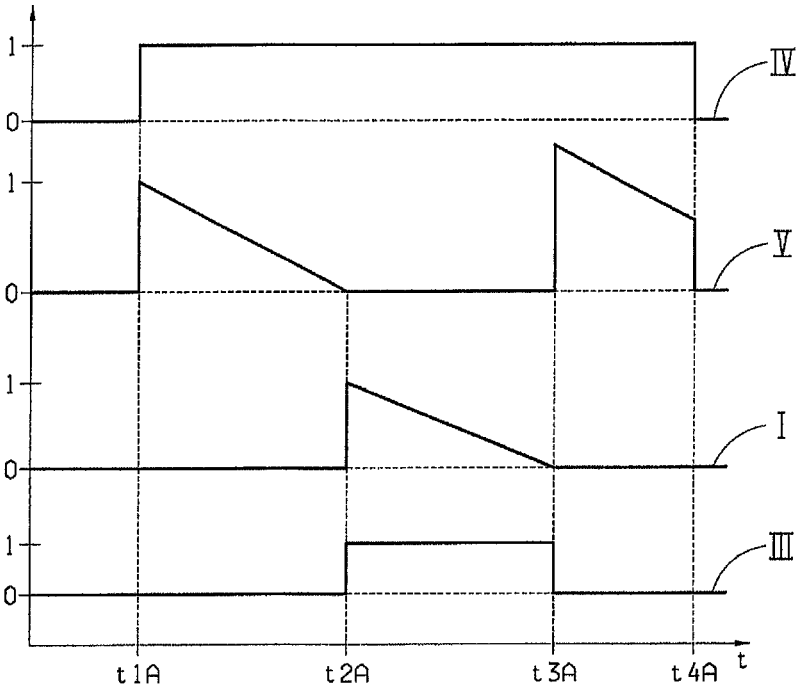
FIG. 2 a graphical representation of the method based on a control timing pattern chart of the auxiliary pump of a detected event, favoring an air suction.
Figure 3:
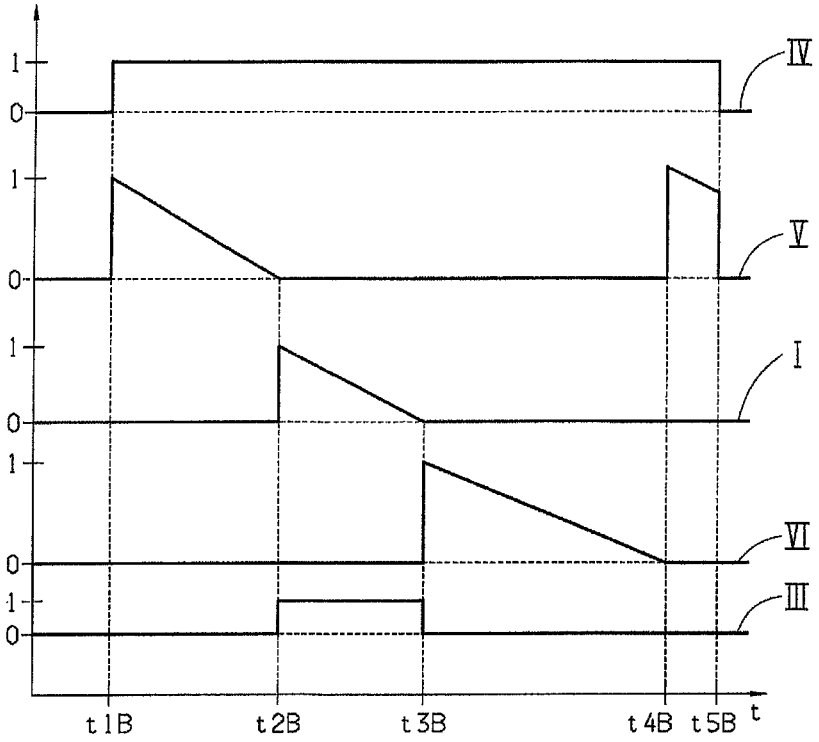
FIG. 3 a graphical representation of the method based on a control timing pattern chart of the auxiliary pump in accordance with FIG. 2, using a blocking time relay.

The FIGS. 1 to 3 show as examples different graphical representation of an inventive method for controlling an auxiliary pump of the hydraulic fluid supply or oil supply, respectively, of a hybrid transmission of a vehicle. Hereby, the figures show different patterns I to IV over the time t, whereby a "0" marks the deactivation of the auxiliary pump or the end of a time duration or time interval, respectively, of an event and whereby a "1" marks the activation of the auxiliary pump or the beginning of a time duration or a time interval or an event, respectively.

In the context of the proposed method, as well as with the proposed device for executing the method, a manner of controlling the auxiliary pump is presented to avoid the suction of air, for instance through foaming transmission oil or similar, without the need for any constructive actions.

In the time controlling course as shown in FIG. 1, the auxiliary pump is activated at the time point t1, after the expiration of the predetermined time interval of not being activated, so as to prevent the suction of air. The duration of the time intervals for the activation and the duration of the time intervals for non-activation of the electric auxiliary pump are determined randomly or empirically. Course I produced from the time intervals in which the auxiliary pump is activated, wherein course II produces the time intervals in which the auxiliary pump is turned off. Course I shows clearly that the auxiliary pump at the time point t2 is again deactivated. Simultaneously, the deactivation time interval starts in accordance with the course II. This time interval ends at the time point t3, so that the auxiliary pump is again activated at this time point. The auxiliary pump is again deactivated at the time point t4. The pattern III shows the activation or rather the control pattern of the auxiliary pump.

The timing course of the auxiliary pump presented in FIG. 2 shows the controlled activation of the auxiliary pump which is executed depending on the presence of an event which is conducive to air suction. The course IV shows the presence or rather detection of an event, like one such as high-speed driving, in which the introduction of air or oil foam is likely in the area of the auxiliary pump. Upon the detection or rather the triggering event, at which the creation of oil foam is possible, a timer or timer/clock is simultaneously started with a deactivated auxiliary pump, wherein the course V shows the timer. It can be seen from this course that the timer is started at the time point t1A when an event is present. The time duration of the timer is selected in a way such that the selected time duration ends at the time point t2A. From the course I, which shows the time intervals in which the auxiliary pump is activated, it can be seen at the time point t2A, this occurs simultaneously at the time point for the activation of the auxiliary pump. After the expiration of the time interval for the activation of the auxiliary pump at the time point t3A, the auxiliary pump is again deactivated, wherein the course V shows that the timer is again restarted. The timer is stopped at the time point t4A because it is recognized that at that time the event is no longer present, which results in the course IV. Thus, the auxiliary pump remains deactivated for the time being.

Finally, FIG. 3 shows an additional triggering timing course for the auxiliary pump in which a blocking timer or blocking timer relay is applied to avoid repeated activation of the auxiliary pump, if the event is still present. Hereby, the activation of the auxiliary pump is prevented for a predetermined time duration. As also shown in the triggering timing course in accordance with FIG. 2, the presence of the event is shown in the course IV. The event starts at the time point t1B, so that the timer/clock in the course IV is started, wherein the selected time duration ends at the time point t2B, so that the activation of the auxiliary pump starts in a time interval as shown in the course I. The auxiliary pump is deactivated at the time point t3B. Simultaneously at the time point t3B, the blocking timer is started which is shown in the course VI. The blocking time duration ends at the time point t4B. Since the event is still present at this time point, the timer is started which is shown in the course V. At the time point t5B, it is determined that the event is no longer present so that the timer is stopped and the auxiliary pump remains turned off for the time being.

REFERENCE CHARACTERS

1 Auxiliary Pump activation time duration, or rather interval, or Start of Event
2 Auxiliary Pump deactivation time duration, or rather interval, or End of Event
t Time
t1 Time Point
t2 Time Point
t3 Time Point
t4 Time Point
t1A Time Point
t2A Time Point
t3A Time Point
t4A Time Point
t1B Time Point
t2B Time Point
t3B Time Point
t4B Time Point
t5B Time Point
I
II
III
IV
V
VI

The invention claimed is:

1. A method of controlling an auxiliary pump which supplies hydraulic oil to a hybrid transmission of a vehicle, the method comprising:

starting a predetermined time interval of deactivation when a predetermined event, which favors suction of air by the auxiliary pump, is simultaneously detected;

deactivating the auxiliary pump simultaneously with starting the predetermined time interval of deactivation and detecting the predetermined event;

activating the auxiliary pump, simultaneously with expiration of the predetermined time interval of deactivation, for a duration of another predetermined time interval of activation so as to avoid accumulation of air at an intake area of the auxiliary pump; and only activating the auxiliary pump upon simultaneous expiration of the predetermined time interval of deactivation, and detection of the predetermined event, which favors the suction of air by the auxiliary pump, upon expiration of the predetermined time interval of deactivation.

2. The method according to claim 1, further comprising the step of selecting the duration of the time interval of deactivation and the time interval of activation of the electric auxiliary pump either randomly or empirically.

3. The method according to claim 2, further comprising the step of storing an end point of the time interval of deactivation and the time interval of activation in a control device as either an activation time point (t1, t2A, t2B, t3) or a deactivation time point (t2, t4, t3A, t3B).

4. The method according to claim 3, further comprising the step of starting a timer at a first time point (t1A, t1B) when simultaneously at the first time point the predetermined event is detected and the auxiliary pump is deactive, and after expiration of a time duration which was set in the timer, activating the auxiliary pump at a second time point (t2A, t2B) for the duration of the other predetermined time interval of activation.

5. The method according to claim 4, further comprising the step of checking, simultaneously with the expiration of the other time interval of activation, at a third time point (t3A) if the detected predetermined event is still present, and restarting the timer again only if the predetermined event is still present.

6. The method according to claim 3, further comprising the step of starting a timer, when the predetermined event at a time point (t1A, t1B) is detected and simultaneously starting a time interval of deactivation during which the auxiliary pump is deactivated, and at an end of the time interval of deactivation, activating and keeping the auxiliary pump activated until the predetermined event is no longer present.

7. The method according to claim 3, further comprising the step of at an end of the time interval of activation of the auxiliary pump, simultaneously starting a blocking time relay if the predetermined event is detected and deactivating of the auxiliary pump, at a time point (t3B) so that, for a predetermined time duration up to another time point (t4B), activation of the auxiliary pump is prevented and restarting the time interval of deactivation at the other time point (t4B), if the detected predetermined event is still present.

8. The method according to claim 1, further comprising the step of controlling the auxiliary pump, depending on detection of unwanted air or oil foam build up at the intake area of the auxiliary pump, by use of a capturing sensor.

9. A device for executing a method for controlling an auxiliary pump for a supply of hydraulic fluid to a hybrid transmission of a vehicle, the method comprising:

upon detecting a predetermined event, which favors suction of air by the auxiliary pump, simultaneously starting a deactivation time interval and deactivating the auxiliary pump to prevent hydraulic oil from being oversupplied to the intake area of the auxiliary pump; and only upon expiration of the deactivation time interval and continued detection of the predetermined event conducive to air production within the intake area starting an activation time interval and simultaneously activating the auxiliary pump to supply hydraulic oil to the hybrid transmission to thereby prevent air intake and to avoid accumulation of air at an intake area of the auxiliary pump; the device further comprising a control device connected with the electric auxiliary pump, and the control device transmitting signals to control the operation of the auxiliary pump.

10. The device according to claim 9, wherein the control device and the signals are connected with an oil foam sensor to detect possible air suction.

11. A method of controlling an electric auxiliary pump for supplying hydraulic fluid to a hybrid transmission of a vehicle, the method comprising:

selecting a duration of a first time interval of activation of the auxiliary pump and a duration of a second time interval of deactivation of the auxiliary pump either randomly or empirically;

starting the second time interval of deactivation of the auxiliary pump simultaneously with detecting a predetermined event, which favors suction of air by the auxiliary pump, and simultaneously deactivating the auxiliary pump at the start of the second time interval;

only activating the auxiliary pump, simultaneously with:

continued detection of the predetermined event, which favors suction of air by the auxiliary pump, expiration of the duration of the second time interval of deactivation of the auxiliary pump, and starting of the first time interval; and maintaining activation of the auxiliary pump, for the duration of the first time interval, in order to avoid accumulation of air at an intake area of the auxiliary pump.

* * * * *